US005251895A

United States Patent [19]

Darling

[11] Patent Number: 5,251,895

[45] Date of Patent: Oct. 12, 1993

[54] SPORTS RACQUET

[76] Inventor: James P. Darling, 3300 Irvine Ave., Suite 385, Newport Beach, Calif. 92660

[21] Appl. No.: 14,061

[22] Filed: Feb. 5, 1993

Related U.S. Application Data

[63] Continuation of Ser. No. 694,893, May 2, 1991, abandoned.

[51] Int. Cl.[5] ..... A63B 49/02

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 1,542,177 | 6/1925 | Rose | 273/73 D |
| 3,884,467 | 5/1975 | Sommer | 273/73 D |
| 4,441,712 | 4/1984 | Guthke | 273/73 D |
| 4,591,165 | 5/1986 | Sines et al. | 273/73 D |
| 4,681,319 | 7/1987 | Zilinskas | 273/73 D |

*Primary Examiner*—William Stoll

*Attorney, Agent, or Firm*—Poms, Smith, Lande & Rose

[57] ABSTRACT

An improved sports racquet has elements placed between the outer edge of the frame and the strings. The elements prevent the strings from touching the outer edge of the frame and move in response to a force applied in a direction generally perpendicular to the strings, thereby expanding the sweet spot, providing improved playability of the racquet, and significantly reducing the vibration that is transferred to the player's arm. Each element has two connected seating portions that seat in receptacles in the outer perimeter of the racquet. Thus, two seating portions move together when a ball strikes the playing surface.

27 Claims, 4 Drawing Sheets

FIG. 7
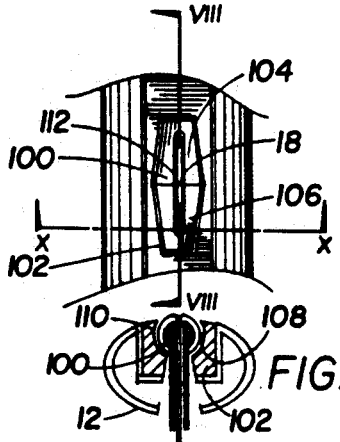
FIG. 8
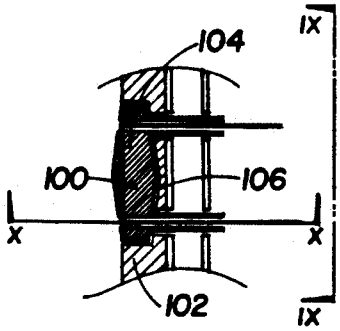
FIG. 9
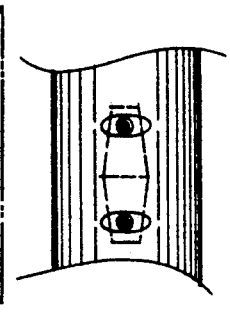
FIG. 10
FIG. 11
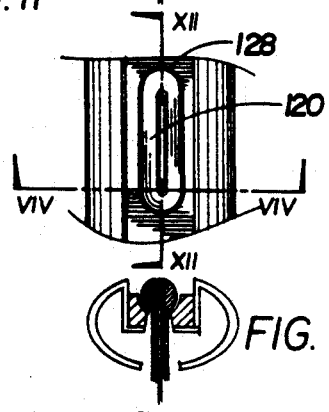
FIG. 12
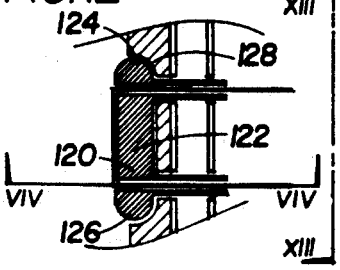
FIG. 13
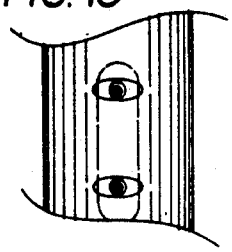
FIG. 14
FIG. 15
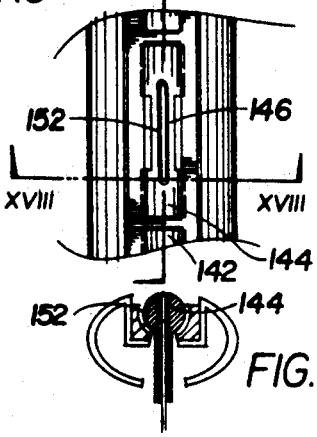
FIG. 16
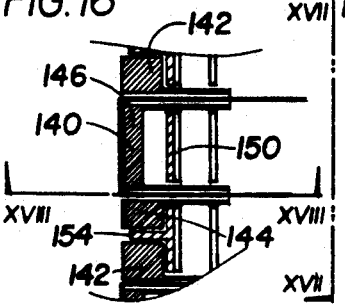
FIG. 17
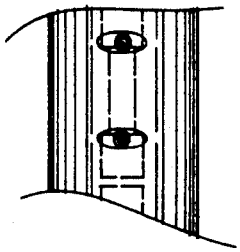
FIG. 18
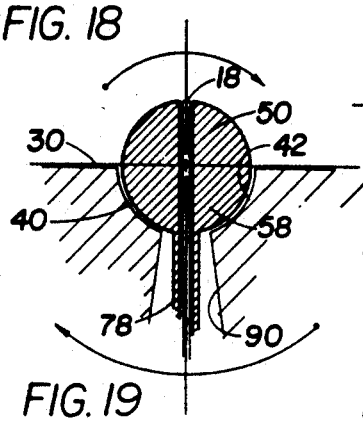
FIG. 19
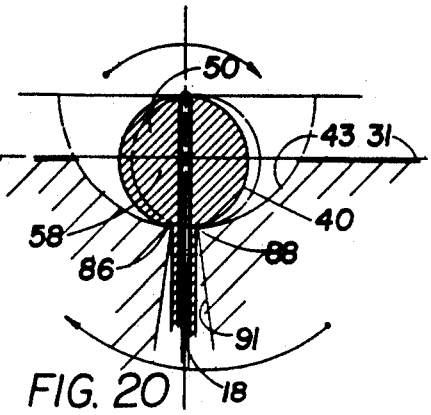
FIG. 20

SPORTS RACQUET

This is a continuation of copending application Ser. No. 07/694,893 filed on May 2, 1991, now abandoned.

BACKGROUND OF THE INVENTION

1. Field of Invention:

This application relates to improved sports racquets having elements positioned on the outside of the frame through which strings pass.

2. State of the Art:

This application describes an improvement of applicant James Darling's earlier U.S. Pat. No. 4,786,055 (Nov. 22, 1988) entitled "Sports Racquet." That patent describes a sports racquet with elements placed between the outer edge of the frame and the strings. The elements prevent the strings from touching the outer edge of the frame and pivot when a ball strikes the playing surface and pushes the strings. The action of the elements increases the area of the sweet spot and dissipates the vibration caused when a ball strikes the playing surface.

The bottom surfaces of the elements described in the earlier patent are preferably spherical or elliptical and seat in receptacles in the racquet frame. The receptacles have a surface with substantially the same curvature as the bottom surface of the elements.

The following references were cited in the earlier patent:

| | | | |
|---|---|---|---|
| 840,467 | 1/1907 | Beard | 273/73D |
| 971,773 | 10/1910 | Mueller | 273/73D |
| 1,526,734 | 9/1925 | Andrews et al. | 273/73D |
| 1,697,814 | 1/1929 | Forbes | 273/73D |
| 3,545,756 | 12/1970 | Nash | 273/73D |
| 3,702,189 | 11/1972 | Galich | 273/73D |
| 3,884,467 | 5/1975 | Sommer | 273/73H |
| 3,926,431 | 12/1975 | Delorean | 273/73D |
| 3,930,648 | 1/1976 | Brown | 273/73D |
| 3,986,716 | 10/1976 | Taussig et al. | 273/73C |
| 3,999,756 | 12/1976 | Head | 273/73C |
| 4,131,279 | 12/1978 | Ogden | 273/73D |
| 4,140,316 | 2/1979 | Coupar | 273/73A |
| 4,184,679 | 1/1980 | Mishel | 273/73D |
| 4,309,033 | 1/1982 | Parker, Jr. et al. | 273/73D |
| 4,330,132 | 5/1982 | Ferrari | 273/73D |
| 4,333,649 | 6/1982 | Vaughn et al. | 273/73D |
| 4,366,959 | 1/1983 | Lacoste | 273/73D |
| 4,408,760 | 10/1983 | Ferrari | 273/73D |
| 4,440,392 | 4/1984 | Popplewell | 273/73C |
| 4,441,712 | 4/1984 | Guthke | 273/73D |
| 4,458,898 | 7/1984 | Boden | 273/73D |
| 4,462,591 | 7/1984 | Kenworthy | 273/73D |
| 4,462,592 | 7/1984 | Legger et al. | 273/73D |
| 4,595,201 | 6/1986 | Fischer | 273/73E |
| 4305 | 1914 | United Kingdom | 273/73D |

Racquets for tennis, racquetball, squash and other racquet sports include a handle, a frame and strings interwoven through the frame to form a playing surface. Players hit a ball, different for each sport, toward a desired location by striking the ball with the string playing surface. A given racquet's power and control depend on many factors: the size, weight and shape of the racquet; the materials from which the racquet and strings are made; the tension of the strings in the racquet frame; and the presence of elements such as those described in applicant's earlier U.S. Pat. No. 4,786,055.

Hitting the ball in the sweet spot, an area usually near and surrounding the center of the playing surface, results in maximum power and control. The sweet spot's location, size and shape varies with racquet shape and design, but making the sweet spot as large as possible is a goal of most racquet designers. Applicant's earlier patent provided an improved sweet spot.

When the ball strikes the strings, the racquet frame vibrates, especially if the ball misses the sweet spot. This vibration is transferred from the racquet frame to the user's arm and can cause tennis elbow or other health problems. Applicant's previous patent describes several solutions to improve the playability of sports racquets and to lessen the transferred vibration inherent in racquet sports. The previous patent also taught an inexpensive and simple design for a sports racquet with an expanded sweet spot that provides improved power and control and lessens the vibration to the player's arm caused by impact of the strings with the ball. The racquet of the present invention improves on that design.

SUMMARY OF THE INVENTION

The improved racquet of the present invention includes a conventional handle and frame. The racquet has a plurality of spaced frame passages disposed in the frame, which extend between the inner perimeter and the outer perimeter of the frame for receiving the strings. As in applicant's earlier patent, a plurality of elements rest in fixed locations on the outer perimeter of the frame. Each element has an element passage means, which extends through the element and receives the strings.

Each element has at least two seating portions, each of which has an element passage at a frame passages such that each of the strings passes through a frame passage and the element passage. The seating portions are those portions of each element located on the outer surface of the element adjacent to the frame passage. In fact, because the seating portion serves as a bearing, the term seating portion can also be described as a bearing portion. The strings do not directly contact the frame. The elements have a connection between adjacent bearing portions to fix the position of adjacent bearing portions relative to each other. The axes of the adjacent element passages move while the location of the element with respect to the frame remains fixed when a sufficient force is applied to the playing surface in a direction generally perpendicular to the playing surface.

More specifically, the sports racquet of the present invention is of a conventional type, having a handle and a generally circular or oval frame. A playing surface is formed in the area within the frame by taking a single string and passing it alternately through spaced passages running from the outer perimeter to the inner perimeter of the frame. A plurality of strings may also be used. For convenience, the playing surface is called "the strings," whether one or several strings forms the playing surface.

The strings of conventional racquets pass through a passage in the frame from the inside to the outside, and then back through an immediately adjacent spaced passage from the outside to the inside. Thus, the strings rest directly on the outer perimeter of the frame between the adjacent spaced passages. Applicant's earlier patent described in its exemplary embodiments single elements, each with a passage through it. These single elements are each in a single receptacle of the outer perimeter of the frame. The passage of each element is aligned with the respective frame passage. The strings run through each spaced passage in the frame, through an element, then through another element and back through the frame.

The elements of the present invention have seating portions at the frame passages that are connected to each other. The two bearing portions are connected in such a way that they may fully join each other or in a way that they are physically separated from each other. The bearing portions of the elements fit into correspondingly shaped receptacles in the frame and rotate within those receptacles in response to a force applied to the playing surface. The receptacles may be formed integrally into the frame, or may be separate sleeves, continuous grommets or race inserts having a curvilinear surfaces for receiving the seating portions.

A sleeve may also extend inward from the bearing portion of the element. Given a constant striking force, varying the length of the sleeve changes the action on the strings by changing the rotation of the elements and the dynamics of the string.

In most of the embodiments of the present invention, the strings pass through the passages through the frames and contact the elements at or above the outer periphery of the frame. In one embodiment, however, the elements each have extensions which extend through the frame passages. Each extension receives adjacent strings inside the inner parameter of the frame.

The elements and receptacles may be made of materials of varying hardness, including but not limited to plastics, polymers of fiber resins, metal, or composites. The passage running through each bearing portion of the element may be radial or curved, and may be drilled or formed by conventional means. Generally, the smaller the bearing portion of the element, the greater the rotation that will occur in response to a given force applied to the playing surface.

When the racquet of the present invention is in use, the ball strikes the playing surface and some of the elements rotate in their receptacles, depending on the location in which the ball strikes the playing surface. Applicant believes that the rotation of the elements allows the strings to move further in response to a given force, which provides greater power and control. Moreover, the elements are believed to rotate to a greater degree as the location of the application of the force moves closer to the edge of the frame, thereby expanding the area of the sweet spot. Additionally, the elements serve to isolate the strings from the frame and, by rotating in response to a force striking the playing surface, to dissipate and dampen the vibration caused by this force.

The elements are staggered. That is, one element on one side of the racquet contacts two adjacent strings, and the adjacent element contacts the next two adjacent strings. The element on the opposite side of the racquet contacts one string from one opposite element and an adjacent string from the adjacent element. The staggering tends to dissipate vibrations because one string that the ball strikes will urge rotation of an element, but the adjacent string, which is not struck by the ball, tends to resist movement and decreases the rotation of that element.

Other features and advantages of the present invention will become apparent from the following detailed description, which, taken in conjunction with the accompanying drawings, illustrates, by way of example, the principles of the invention.

BRIEF DESCRIPTION OF THE DRAWINGS

FIG. 7 is an enlarged view of a tapered element alternative embodiment of the present invention looking from the outside perimeter of the frame.

FIG. 8 is a sectional view taken through plane 8—8 of FIG. 7.

FIG. 9 is a sectional view taken at plane 9—9 of FIG. 8.

FIG. 10 is a sectional view taken through plane 10—10 of FIGS. 7 and 8.

FIG. 11 is an enlarged view of a capsule element alternative embodiment of the present invention looking from the outside perimeter of the frame.

FIG. 12 is a sectional view taken through plane 12—12 of FIG. 11.

FIG. 13 is a sectional view looking at plane 13—13 of FIG. 12.

FIG. 14 is a sectional view taken through plane 14—14 of FIGS. 11 and 12.

FIG. 15 is an enlarged view of an end supported cylinder element alternative embodiment of the present invention looking from the outside perimeter of the frame.

FIG. 16 is a sectional view taken through plane 16—16 of FIG. 15.

FIG. 17 is a sectional view looking taken at plane 17—17 of FIG. 16.

FIG. 18 is a sectional view taken through plane 18—18 of FIGS. 15 and 16.

FIG. 19 is a sectional view of an embodiment of the element of present invention mating in a receptacle.

FIG. 20 is an sectional view of an embodiment of the element of present invention in which the element can rock in a receptacle.

DETAILED DESCRIPTION OF THE PREFERRED EMBODIMENTS

Figure 1:
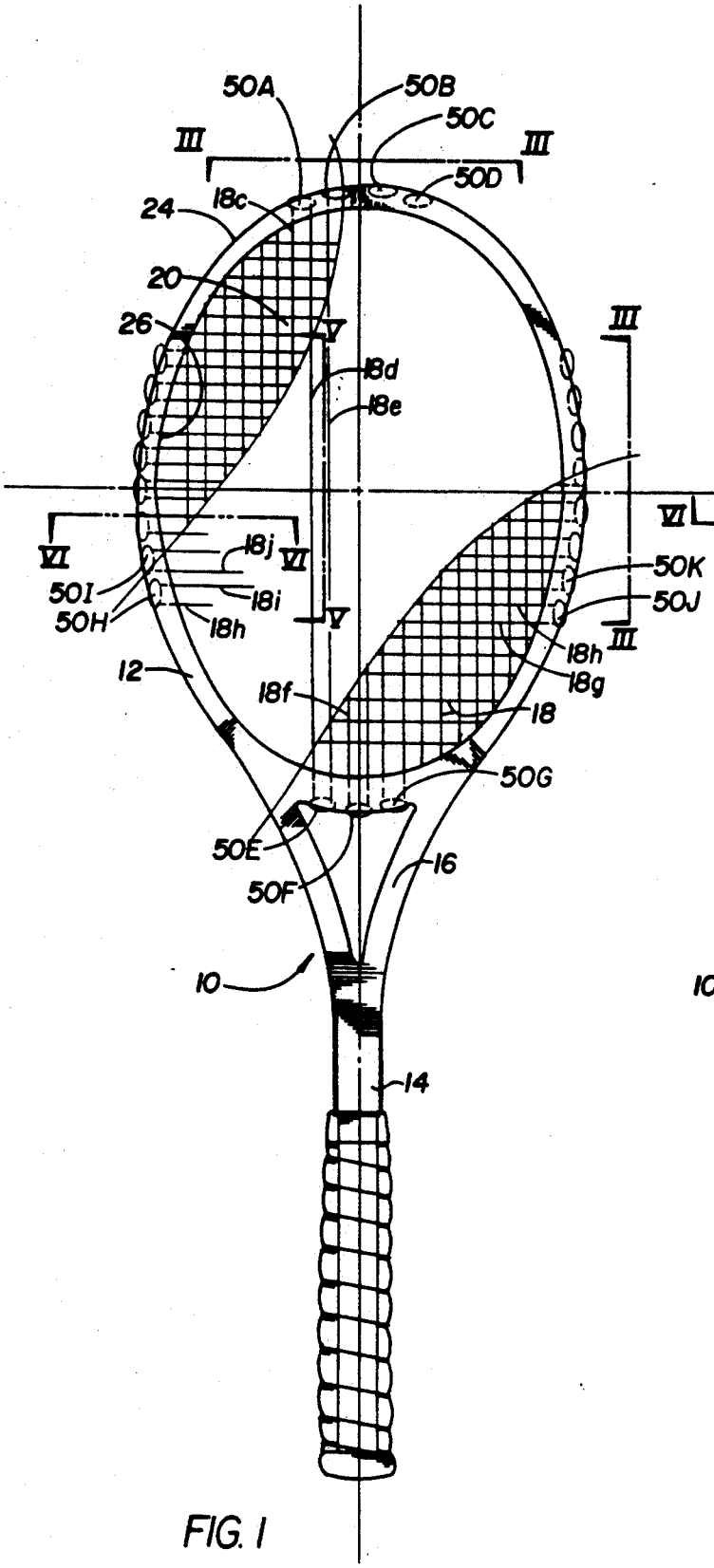
FIG. 1 is a front view of the sports racquet of an exemplary embodiment of the present invention.

Although the invention has applicability to other sports' racquets, the exemplary embodiments describe a tennis racquet 10. The racquet 10 has a frame 12 and a handle 14 (FIGS. 1 and 2) on opposite sides of yoke 16. Strings 18 are interwoven transversely and longitudinally within frame 12 to create playing surface 20. A single interwoven string or several interwoven strings may form playing surface 20, but in both cases, they are called "strings."

The perimeter of frame 12 contains a plurality of spaced frame passages 22 (FIG. 2 and 4) running from the outside perimeter 24 to the inside perimeter 26 of the frame (FIGS. 1 and 3–6). In conventional racquets, the strings pass only through the frame passages for anchoring the strings to the frame. In the present invention, however, the strings pass through portions of elements positioned at the frame passages 22.

The frame passages in some racquets are not evenly spaced. In one major manufacturer's tennis racquet, the frame passages for the vertical strings near the center of the playing surface are 10.0 mm apart. Other frame passages are 11.0 mm, 12.0 mm, 12.5 mm, 13.0 mm or more. Also, spacing for horizontal strings may be different for the spacing for vertical strings.

Figure 2:
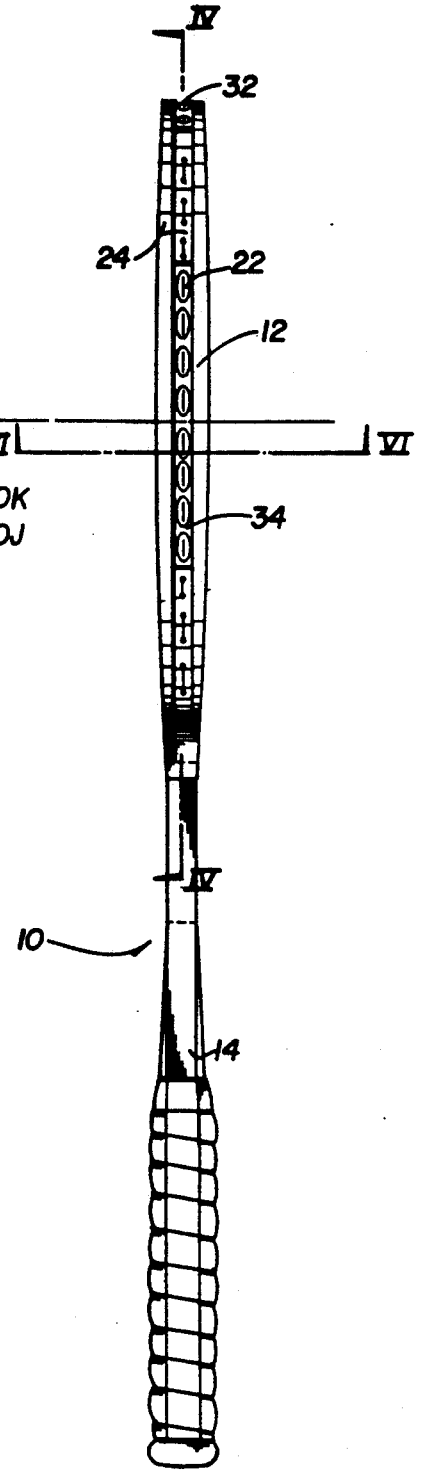
FIG. 2 is a side view of the sports racquet of the exemplary embodiment of the present invention that is shown in FIG. 1.

Referring first to the exemplary embodiment of FIGS. 3–6, race insert 30 seats in outer perimeter 24. As will be explained, the race can be of a friction reducing material such as du Pont Delrin® AF, a Teflon® alloyed acetal or of any hard material with similar properties. Vibration damping is one property of Delrin® AF, and one of the objects of the invention is vibration damping. Race insert 30 can extend around the entire outside perimeter, or it can be divided into four sections at the 12:00, 3:00, 6:00 and 9:00 o'clock frame positions. FIG. 2 of the exemplary embodiment shows two sections 32 and 34.

Figure 6:
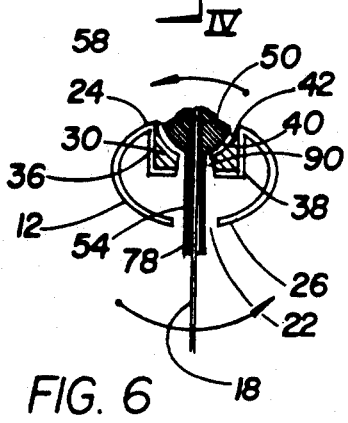
FIG. 6 is a sectional view taken through plane 6—6 of FIG. 3.

Race insert 30 seats between shoulders 36 and 38 in outer perimeter 24 of the frame. It may be held in place by friction, an adhesive or force from the strings. The race insert has outer walls than conform to the shoulders to secure the race insert in place. The outer surface 42 of the race insert has curvilinear regions or is entirely curved along its width as FIG. 6 shows. In the exemplary embodiment of FIG. 4, portions 46 of the race insert are also curved along the length of the race between two frame passages 22. The region between two frame passages forms a receptacle 44.

Figure 3:
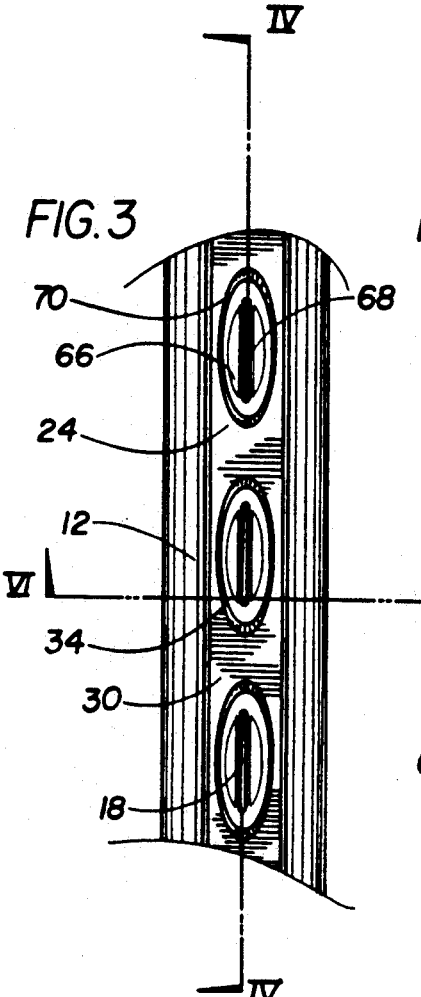
FIG. 3 is an enlarged top view looking through plane 3—3 of an exemplary embodiment of FIG. 1.
Figure 4:
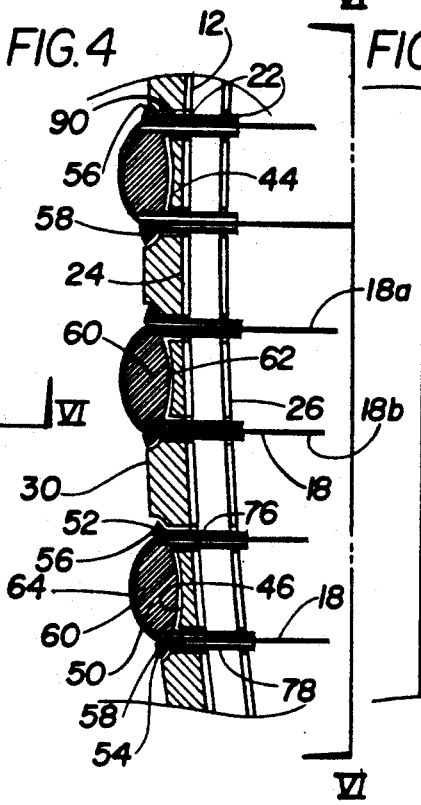
FIG. 4 is an enlarged sectional view taken through plane 4—4 of FIGS. 2 and 3.
Figure 5:
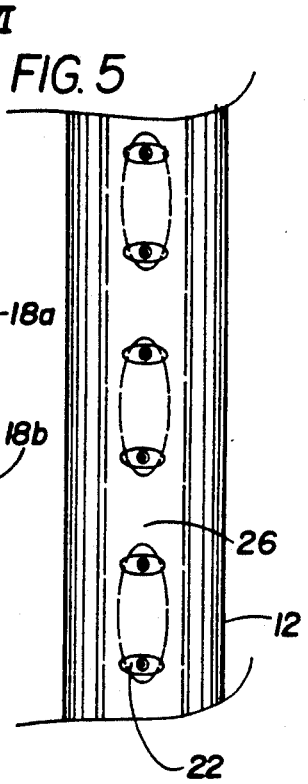
FIG. 5 is an enlarged view looking at plane 5—5 of FIG. 4.

As FIGS. 3 through 6 show, a plurality of elements 50 rest in the race insert. Each element has two element passages 52 and 54 in respective spaced-apart seating portions 56 and 58, which connecting portion 60 connects together. In this embodiment, the two bearing portions are connected in a way in which they fully join each other to create effectively one flush surface. In the exemplary embodiment, the element passages have a 1.25 mm inside diameter. The element passages are guideways in the element through which the strings can travel into the element from the playing surface and then out of the element back to the playing surface of the racquet. As FIG. 4 shows, connecting member 60 is somewhat elliptical in cross section, and its bottom surface 62 conforms to the curved surface 42 of race insert 30. The outer surface 64 is curved in cross section (FIG. 4). FIG. 3 shows that the outer face 66 is elliptical. The curved surface 64 visible in FIG. 4 is formed on a bridge 68 (FIG. 3). In this exemplary embodiment, some space 70 (FIG. 3) exists between elements 50 and receptacle 44.

As FIG. 1 shows, elements 50A, 50B, 50C and 50D are not in the same plane. The receptacles may be stepped to accommodate the positions of the elements. Alternatively, the elements can follow a curved race.

In applicant's earlier patent, the bearing portion of each element was independent and each element rested in its own receptacle. In the present invention, connecting portion 60 connects two bearing portions such as portions 56 and 58 together. Although three or more seating portions could be connected together, the elements of the exemplary embodiments have only two bearing portions connected to each other. Positioning elements 50 in receptacle 44 positions the seating portions properly with respect to the frame passages 22. String tension holds the elements in their receptacle.

In the exemplary embodiment of FIGS. 3–6, the element passages include sleeves 76 and 78 through which element passages 52 and 54 continue. The preferred sleeves have a 1.25 mm inside diameter with 0.5 mm sidewalls. The preferred sleeve length is between 13 mm and 20 mm but can vary among racquets. As discussed further, the preferred embodiment uses elements having slightly varying sizes to accommodate variances in spacing of the frame passages different size frame passages and the curvature and possible stepped nature of race insert 30.

String 18 enters element passage 52, which also extends through sleeve 76. String 18 then extends over the bridge 68 of element 50 and then back through element passage 54 and sleeve 78.

FIG. 6 shows that the curved surface 40 of the element's bearing portion generally conforms to the curvature 42 of race insert 30. When a ball strikes playing surface 20 (FIG. 1), the strings move in response to the ball's force. Some strings move more than others. If a ball moves that portion of string 18 shown in FIG. 6, element 50 rotates on the race insert, but because element 50 controls two strings 18*a* and 18*b* (FIG. 4), both strings respond to movement of one string.

Because strings 18*a* and 18*b* probably bow slightly where they would contact element passages 52 and 54, sleeves 76 and 78 decrease the bowing near the pivot point of element 50. Varying the length of sleeves 76 and 78 produces different results.

In each of the embodiments, the sleeves (e.g., sleeves 76 and 78 (FIG. 4)) are perpendicular to the connecting portion (e.g., connecting portion 60). The sleeves could be angled slightly, especially if the race insert is not stepped so that the element would be angled to its strings. The sleeve angle would cause the sleeve to be aligned with its string.

The elements on opposite sides of the racquet are staggered. That is, two strings 18*c* and 18*d* contact element 50A (FIG. 1), and two other strings 18*e* and 18*f* contact another element 50B on the top of frame 12. The staggering occurs because string 18*d* from element 50A and string 18*e* from element 50B extend to the bottom of the playing surface 20 across frame 12 and contact a single element 50E (FIG. 1). Likewise the string 18*e* from element 50E and string 18*f* from element 50F extend to the same element 50B across the playing surface. The elements of the horizontal strings are also staggered. String 18*g* from element 50J contacts no element on the other side of the frame (FIG. 1). String 18*h* from element 50H extends to element 50J and string 18*i* from element 50H extends across the playing surface element 50K.

The inside perimeter 26 has wide frame passage 22 (FIGS. 5 and 6) to accommodate pivoting of element 50. Likewise, race insert 30 has openings 90 (FIG. 4) aligned with frame passages 22. If the element has attached sleeves 76 and 78, which extend through frame passage 22, the width size of the frame passages 22 and opening 90 will have to be large enough to accommodate the sleeves, but even without the sleeves, it will have to be large enough to accommodate anticipated string movement.

FIG. 19 shows in somewhat more detail how element 50 mates with the receptacle. Curved portion 42 of race insert 30 generally conforms to the curved outer surface 40 of the element's seating portion 58. Tension from string 18 pulls seating portion 58 toward the curved portion 42 of the race insert. Force from a ball's impact on the string causes element 50 to rotate such that the surfaces mating between the seating portion and the race insert slide relative to each other. In the FIG. 19 embodiment, therefore, minimizing friction is important. In FIG. 20, curved portion 43 of race insert 31 does not conform to outer surface 40 of bearing portion 58 of element 50. String 18 causes element 50 to rock, beginning either at points 86 or 88 and move slightly as rotation increases or decreases. The differences in the arrangements between FIGS. 19 and 20 provide different action.

The staggering contributes to the improved play of the racquet. If the principal load of a ball striking playing surface 20 pushes strings 18*c* and 18*d* (FIG. 1), both strings pivot element 50A on the top of frame 12, but only one of those strings, string 18*d*, exerts a force on element 50E on the opposite side of the playing surface. Although in actual practice, more than two strings will be affected, at least one of the element only will be affected by a single strings' movements. The adjacent string associated with that element will not be affected by the force of the ball, and that string will act to damp movement of the element. That, in turn, contributes to damping of the vibrations in the entire racquet.

The embodiments of FIGS. 7–10, 11–14 and 15–18 show three different modified embodiments, primarily showing changes in the element and the portion of the race insert that receives the element. In the first of these, FIGS. 7–10, element 100 is tapered and self-centering, and race insert 102 accommodates the tapered shape. That is, element 100 has two truncated, generally conical sections 104 and 106 connected at the wider base. Curved surface 108 of race insert 102 (FIG. 10) generally conforms to the outer surfaces 110 of element 100. String 18 sits in a groove 112 (FIG. 7) on the outer surface of element 100.

The FIG. 11–14 embodiment has a capsule element 120. The element is shaped like a capsule having a cylindrical center region 122 and two end caps 124 and 126. Race insert 128 is shaped to accommodate capsule-shaped element 120. In the embodiment of FIGS. 15–18, element 140 is supported on its end by two cylindrical element ends 142 and 144 connected together by a central connecting bridge 146. This connecting bridge's shape is chosen for strength and cost of manufacturing and does not contact race insert 150.

Note also the simplified shape of race insert 150 in this embodiment. The race insert has a groove 152 (FIGS. 15 and 18) that conforms generally to the outside surface of cylindrical element ends 142 and 144. Short spacer flanges 154 project outward from race insert 150 to act as a spacer between adjacent cylindrical end members 144 and 142 of adjacent elements 140.

In FIGS. 10, 14 and 18 of the three embodiments, the bearing portion of the element generally conforms to a portion of the race insert. Each of these embodiments could be modified to be more similar to FIG. 20. In the FIG. 19 embodiment, the surface on the element and the surface on the race insert that contact each other are cylindrical, but they can be of other curvilinear shapes that can conform to each other (similar to FIG. 19). The elements can also be of varying sizes (as in FIG. 20).

Figure 21:
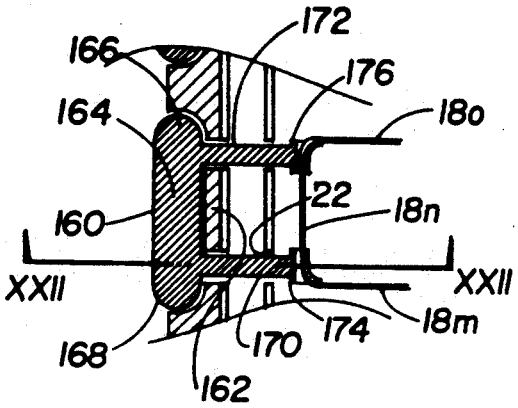
FIG. 21 is a sectional view in a direction similar to the view in FIG. 16 of an alternative embodiment in which the strings connect to the element inside the inner perimeter of the frame.
Figure 22:
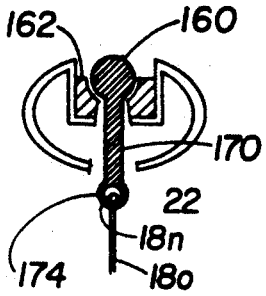
FIG. 22 is a sectional view taken through plane 22—22 of FIG. 21.

The embodiments of FIGS. 21 and 22 differ from the other embodiments in that the strings contact the element inside the perimeter of the racquet. In this embodiment, each element has a pair of generally radial extensions extending from each end of the element through adjacent frame passage from the outer perimeter past the inner perimeter. Each extension has an opening which receives adjacent strings. Turning to FIGS. 21 and 22, element 160 is supported in race insert 162. Although element 160 has a center region 164 and two end regions 166 and 168 similar in shape to element 120 in the FIGS. 11–14 embodiment, the shape can be similar to the shapes of the other embodiments and to equivalent shapes also.

Extensions 170 and 172 extend inward from center section 164 of the element through frame passages 22 past the inside perimeter of the frame. Each extension has a ring 174 and 176 at the inside end of the extension. Instead of having the strings extend through the frame passages 22 and over the top of element 160, strings 18*m* and 18*o* extends through rings 174 and 176, and the string traverses at 18*n* between rings 174 and 176. Thus, the string connects to the element inside the frame. When the ball strikes the strings, the force on the strings causes element 160 to rotate in race insert 162.

The FIGS. 21 and 22 embodiment can be combined with the other embodiments if desired. Furthermore, varying the length of extensions 170 and 172 will yield different results. Likewise, the extension could angle slightly with respect to the center section 162 of the element for similar reasons to angling the sleeves.

Figure 23:
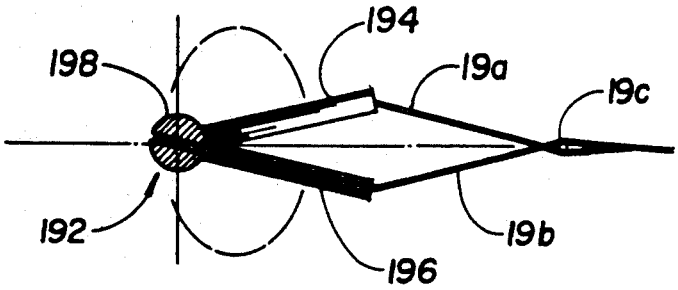
FIG. 23 is a sectional view similar to FIG. 6 of another alternative embodiment of the element of the present invention.

In the previous embodiments having depending sleeve (e.g., sleeves 76 and 78 in FIG. 4) and the depending extensions (e.g., extensions 170 and 172 in FIG. 22) are aligned with each other. Alternatively, FIG. 23 shows splayed sleeves 194 and 196 depending from connecting portion 198 of element 192. As FIG. 23 shows, strings 19*a* and 19*b* are not exactly straight from the sides of the frame because of the weaving effect with perpendicular strings such as string 19*c*. Splaying the sleeves exaggerates the weaving effect. Although not shown in the drawings, extensions 170 and 172 in FIG. 22 could also be splayed.

Figure 24:
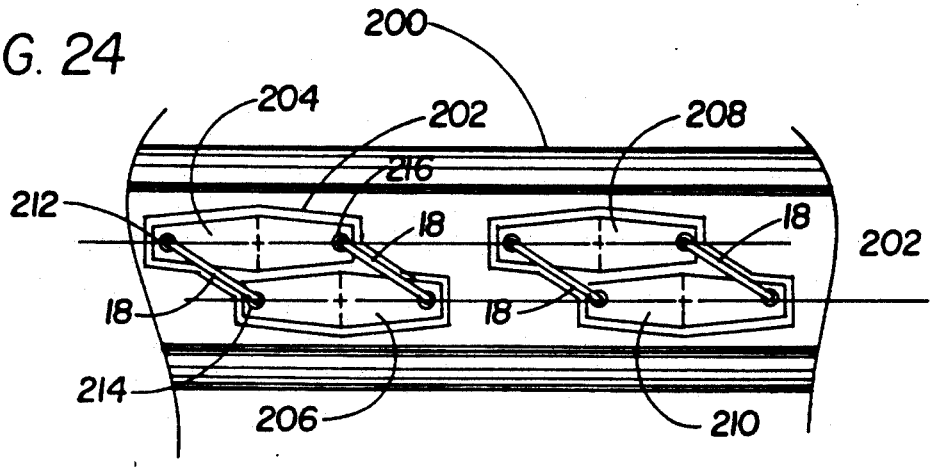
FIG. 24 illustrates another embodiment of the invention.

In each of the illustrated embodiments, the axes of adjacent elements are aligned with each other and the elements were generally evenly spaced. As FIG. 24 shows, the elements' axes could be offset to each other. That is, elements 204, 206, 208 and 210 mount in race insert 202 in frame 200. The axes of adjacent elements are not aligned; instead, the axis of every other element is aligned with each other. In other embodiments, one string would enter the end of an element and one adjacent string entered the other end of the same element and the other adjacent string entered the near end of the adjacent element. In the FIG. 24 embodiment, one string enters the end 212 of element 204, but the adjacent string enters end 214 of the adjacent element 206. The next string enters the other end 216 of the first element 204. This arrangement provides a different playability than other embodiments.

These alternative embodiments are provided by means of illustration only, and the invention is not limited to any particular element shape. Any shape of element capable of movement in response to a force applied to the playing surface 20 is within the scope of the present invention.

The elements of the present invention are preferably comprised of plastic materials such as acetal, a polyoxymethylene type acetal resin. Such materials generally have a hardness ranging from about R85 to R120 on the Rockwell hardness scale. The elements may also be comprised of metals, or a composite of plastic and metal. The elements may also be formed by injection molding methods. Element passages (e.g., passages 52 and 54) may be formed either during the molding process or by drilling. Race insert 30 is formed of a compatible material. It is preferable if the element, race insert or both are of a reduced-friction material.

Although the race insert is shown as a separate element in each of the embodiments, its shape could be incorporated as an integral element in the outer perimeter of the frame, depending on the material used for the frame and its method of manufacturing.

One strings the racquet of the present invention on a conventional stringing machine. The strings are inserted through the element passage and either over the element (FIGS. 3–19) or between the extensions (FIGS. 20 and 21). The strings hold the elements in place. Thus, original equipment sports racquet may include the race and elements, or they may be added to sports racquets when such racquets are restrung.

The sports racquet of the present invention provides significant advantages over those previously known in the art. The elements of the present invention are inexpensive and simple to fabricate, yet when added to a conventional sports racquet, they greatly increase playability of the racquet and reduce the vibration that is transferred from the racquet to the player's arm, particularly when a ball strikes the racquet off-center.

Those skilled in the art will appreciate that one can construct other sports racquets without departing from the spirit and scope of the present invention. Thus, the foregoing description is meant for illustrative purposes only. The present invention is not intended to be limited in any way, except as by the appended claims.

I claim:

1. A sports racquet comprising:

(a) a handle and a frame attached to or integral with the handle, the frame having an inner perimeter and an outer perimeter, the frame having a plurality of spaced frame passages disposed in the frame and extending between the inner perimeter and the outer perimeter of the frame, and said frame having strings disposed within the frame in a generally cross-networked array to form a playing surface;

(b) a plurality of elements having passages, contacting and resting in a fixed location on the outer perimeter of the frame, each element having two ends located at a position aligned with adjacent frame passages wherein each element has a bottom portion on its outer surface that is closest to the center of said playing surface and a top portion on its outer surface that is further from the center of said playing surface, a rotational axis that is generally parallel to said playing surface and generally orthogonal to the string received in said element, being aligned with one of said frame passages such that each of said strings pass through said frame passage and said element passage so that said strings are prevented from contacting the frame, said elements being positioned such that, when a sufficient force is applied to said playing surface in a direction generally perpendicular to said playing surface, the axis of said element passage moves but the location of said element with respect to the frame does not change, the top portion of said element rotating about the rotational axis of said element toward a direction opposite to the direction of application of the force; and (c) adjacent strings being aligned with adjacent frame passages and received in each element, the adjacent strings extending between the adjacent frame passages at an element.

2. The sports racquet of claim 1, wherein each element has: (a) element passages extending through the element for receiving the strings; and (b) at least two bearing portions, each of which is located at an end of the element, an element passage extending through each bearing portion.

3. The sports racquet of claim 1, wherein each element has a pair of generally radial extensions extending from each end of the element and wherein each radial extension passes through its adjacent frame passage from the outer perimeter past the inner perimeter, and openings through each of the extensions for receiving adjacent strings.

4. The sports racquet of claim 1, wherein adjacent elements are spaced along the outer perimeter of the frame; one end of a first element being at a frame passage and the end of the second, adjacent element, which end is closer to the one end of the first element being at the adjacent frame passage, the adjacent strings at the one end of the first element and at the closer end of the second element crossing the playing surface and contacting the ends of a single element on the other side of the playing surface from the first and second elements.

5. The sports racquet of claim 1 further comprising a receptacle on the outer perimeter of the frame, the receptacle being sized to receive a bearing portion in a manner permitting the axis of each element passage to move.

6. The sports racquet of claim 1 further comprising a race insert and means on the outer perimeter of the frame for receiving at least one race insert, each race insert having at least one receptacle, the receptacle having an opening adjacent a frame passage, the receptacle being sized to receive a bearing portion in a manner permitting the axis of each element passage to move.

7. The sports racquet of claim 6 wherein the receptacles have a curvilinear surface, the bearing portion of the element having a curvilinear surface against the curvilinear surface of the receptacle.

8. The sports racquet of claim 6 wherein the curvilinear surface of the receptacle conforms to the curvilinear surface of the bearing portion.

9. The sports racquet of claim 6 wherein the curvilinear surface of the receptacle is larger than the curvilinear surface of the bearing portion.

10. The sports racquet of claim 1 further comprising a sleeve extending from each seating portion toward the inner perimeter of the frame.

11. The sports racquet of claim 10 wherein the sleeves of each element are parallel with each other.

12. The sports racquet of claim 10 wherein the sleeves of each element are splayed from each other.

13. The sports racquet of claim 1 wherein the portion of the frame passages on the inside perimeter of the frame are of sufficient diameter such that the strings do not contact the frame when the sufficient force is applied to the playing surface.

14. The sports racquet of claim 1 wherein the adjacent strings extend between the adjacent frame passages at the same element.

15. In a sports racquet comprising: a handle; a frame attached to or integral with the handle, the frame having an inner perimeter and outer perimeter, the frame having a plurality of spaced frame passages disposed in the frame and extending between the inner perimeter and the outer perimeter of the frame for receiving strings; strings disposed within the frame in a generally cross-networked array to form a playing surface; the strings extending through the frame passages; and a plurality of elements contacting and resting in a fixed location on the outer perimeter of the frame, each element having element passages extending through the element for receiving the strings; the improvement comprising the provision of:

(a) each element having at least two bearing portions located at adjacent frame passages, having an element passage extending through each bearing portion, and each element passage having an axis; and (b) connecting means extending between adjacent bearing portions for fixing the position of adjacent bearing portions relative to each other, the elements being positioned such that the axes of the adjacent element passages move as the location of the element with respect to the frame remains fixed when a sufficient force is applied to the playing surface in a direction generally perpendicular to the playing surface.

16. The improvement of claim 15 further comprising the provision of each element having two bearing portions and means connecting the bearing portions together.

17. The improvement of claim 15 further comprising the provision of a receptacle on the outer perimeter of the frame, the receptacle having an opening adjacent a frame passage, the receptacle being sized to receive a seating portion in a manner permitting the axis of each element passage to move.

18. The improvement of claim 15 further comprising the provision of a race insert and means on the outer perimeter of the frame for receiving at least one race insert, each race insert having at least one receptacle, the receptacle having an opening adjacent a frame passage, the receptacle being sized to receive a bearing portion in a manner permitting the axis of each element passage to move.

19. The improvement of claim 15 wherein the receptacles have a curvilinear surface, the bearing portion of the element having a curvilinear surface against the curvilinear surface of the receptacle.

20. The improvement of claim 19 wherein the curvilinear surface of the receptacle conforms to the curvilinear surface of the bearing portion.

21. The improvement of claim 19 wherein the curvilinear surface of the receptacle is larger than the curvilinear surface of the bearing portion.

22. The improvement of claim 15 further comprising a sleeve extending from each bearing portion toward the inner perimeter of the frame.

23. The sports racquet of claim 22 wherein the sleeves of each element are parallel with each other.

24. The sports racquet of claim 22 wherein the sleeves of each element are splayed from each other.

25. The sports racquet of claim 15 wherein the portion of the frame passages on the inside perimeter of the frame are of sufficient diameter such that the strings do not contact the frame when the sufficient force is applied to the playing surface.

26. The improvement of claim 15, wherein adjacent elements are spaced along the outer perimeter of the frame such that one end of one element is at a frame passage and the closer end of the adjacent element is at the adjacent frame passage, the adjacent strings at one end of the one element and at the closer end of the adjacent element crossing the playing surface and contacting the ends of a single element.

27. In a sports racquet comprising: a handle; a frame attached to or integral with the handle, the frame having an inner perimeter and an outer perimeter, the frame having a plurality of spaced frame passages disposed in the frame and extending between the inner perimeter and the outer perimeter of the frame for receiving strings; strings disposed within the frame in a generally cross-networked array to form a playing surface; the strings extending through the frame passages; and a plurality of elements contacting and resting in a fixed location on the outer perimeter of the frame, each element having element passages extending through the element for receiving the strings; the improvement comprising the provision of:

(a) each element having bearing portions located at adjacent frame passages, element passages extending through each bearing portion, and each element passage having an axis; and (b) connecting means extending between adjacent bearing portions for fixing the position of adjacent bearing portions relative to each other, the elements being positioned such that the axes of the adjacent element passages move as the location of the element with respect to the frame remains fixed when a sufficient force is applied to the playing surface in a direction generally perpendicular to the playing surface.

* * * * *